United States Patent [19]

Landry

[11] Patent Number: 4,766,627

[45] Date of Patent: Aug. 30, 1988

[54] BED PAD SUPPORT FOR AN INVALID

[75] Inventor: Lela C. Landry, Sulphur, La.

[73] Assignee: Brumline USA, Inc., Sulphur, La.

[21] Appl. No.: 832,418

[22] Filed: Feb. 24, 1986

[51] Int. Cl.[4] ..... A47C 27/08; A47C 27/00

[52] U.S. Cl. ..... 5/446; 5/448; 5/450

[58] Field of Search ..... 5/499, 500, 502, 420, 5/482, 417, 448, 436, 446, 449, 480, 501

[56] References Cited

U.S. PATENT DOCUMENTS

| | | | |
|---|---|---|---|
| 1,791,725 | 2/1931 | Joseph | 5/480 |
| 1,841,410 | 1/1932 | Karr | 5/500 |
| 2,021,237 | 11/1935 | Karr | 5/500 |
| 2,062,786 | 12/1936 | Horan | 5/448 X |
| 2,184,808 | 12/1939 | Belian | 5/468 X |
| 2,348,807 | 5/1944 | Goodstein | 5/502 |
| 3,459,179 | 8/1969 | Olesen | 5/449 X |
| 3,691,570 | 9/1972 | Gaines | 5/502 |
| 3,801,420 | 4/1974 | Anderson | 5/502 |
| 3,965,503 | 6/1976 | Girdel | 428/74 |
| 3,968,530 | 7/1976 | Dyson | 5/449 X |
| 4,060,863 | 12/1977 | Craig | 5/436 X |
| 4,338,693 | 7/1982 | Vitale | 5/500 |
| 4,518,649 | 5/1985 | Wang et al. | 428/284 |

FOREIGN PATENT DOCUMENTS

| | | | |
|---|---|---|---|
| 645151 | 3/1964 | Belgium | 5/480 |
| 1107411 | 8/1981 | Canada | 5/500 |
| 25177 | 12/1951 | Finland | 5/448 |
| 500136 | 3/1920 | France | 5/480 |
| 89493 | 5/1967 | France | 5/502 |
| 2457656 | 5/1979 | France . | |
| 15210 | 11/1897 | Switzerland | 5/448 |
| 199143 | 8/1938 | Switzerland | 5/502 |
| 3535 | of 1914 | United Kingdom | 5/448 |
| 447657 | 5/1936 | United Kingdom | 5/502 |
| 573667 | 11/1945 | United Kingdom | 5/502 |
| 1303002 | 1/1973 | United Kingdom . | |

*Primary Examiner*—Michael F. Trettel

*Attorney, Agent, or Firm*—A. Robert Theibault

[57] ABSTRACT

The present disclosure relates to a buoyant bed pad support for an invalid and has a rectangular top and bottom sheet of cotton muslin and polyethylene fabric enclosing a buoyant batting filler of a loosely hollow slick polyester garnetted into a batting. A rectangular line of quilt-like stitching is set in from the boundary of the perimeter of said top and bottom sheet. Transverse quilt-like stitching between the longitudinal runs of said rectangular line of stitching is also set in from the perimeter of the top and bottom stitching dividing the internal set in rectangular line of stitching into a plurality of channels containing air and buoyant batting filler wherein the transverse stitching stops short of the set in longitudinal stitching leaving an opening between adjacent transverse panels to permit passage of air between channels so that the bed pad is not so rigid as to not provide a resilient support for the invalid.

1 Claim, 1 Drawing Sheet

BED PAD SUPPORT FOR AN INVALID

BACKGROUND OF THE INVENTION

Heretofore numerous mattress covers and pads for beds of patients confined thereto over extensive time periods have been known. Patents on such structures are U.S. Pat. Nos. 3,691,570, 3,965,503, 4,338,693, 3,801,420, 4,518,649. British No. 1,303,002 and French No. 2,457,666 advanced quilt covers about air trapped channels containing resilient filler.

SUMMARY OF THE INVENTION

The present disclosure is directed to a bed pad which either covers the entire top of the mattress or a segment of the top of the mattress which would lie beneath the hips and buttocks area of the patient or the shoulder area of the patient to afford the patient, who could not get up or move about readily, comfortable support to reduce bed sores or irritated areas and which at the same time may be readily removed, laundered and replaced. The pad of the present invention has the thickness of a down quilt, but is not a quilt, it is a body support between the patient and mattress and is provided with hold down straps to keep it positioned correctly beneath the patient. The pad has a top and bottom woven covering stitched around the edges and between the covers is a fiber fluff of a slick polyester of 6 denier filaments garnetted into a batting filler which has been quilt stitched into buoyant interconnected channels to provide a buoyant flexible support to the body of an invalid confined to a bed over prolonged periods of time.

An object of the present invention is to provide a body support of lightweight, not a body cover, which because of its filler and entrapped air cooperating with the lines of stitching which pass through the top and bottom cover-sheets as well as the puff filler in quilt stitch like form is easy to handle, easy to launder and provides hours of comfort for a patient confined to bed while minimizing the likelihood of bed sores or patient discomfort.

THE BEST MODE FOR CARRYING OUT THE INVENTION

Figure 1:
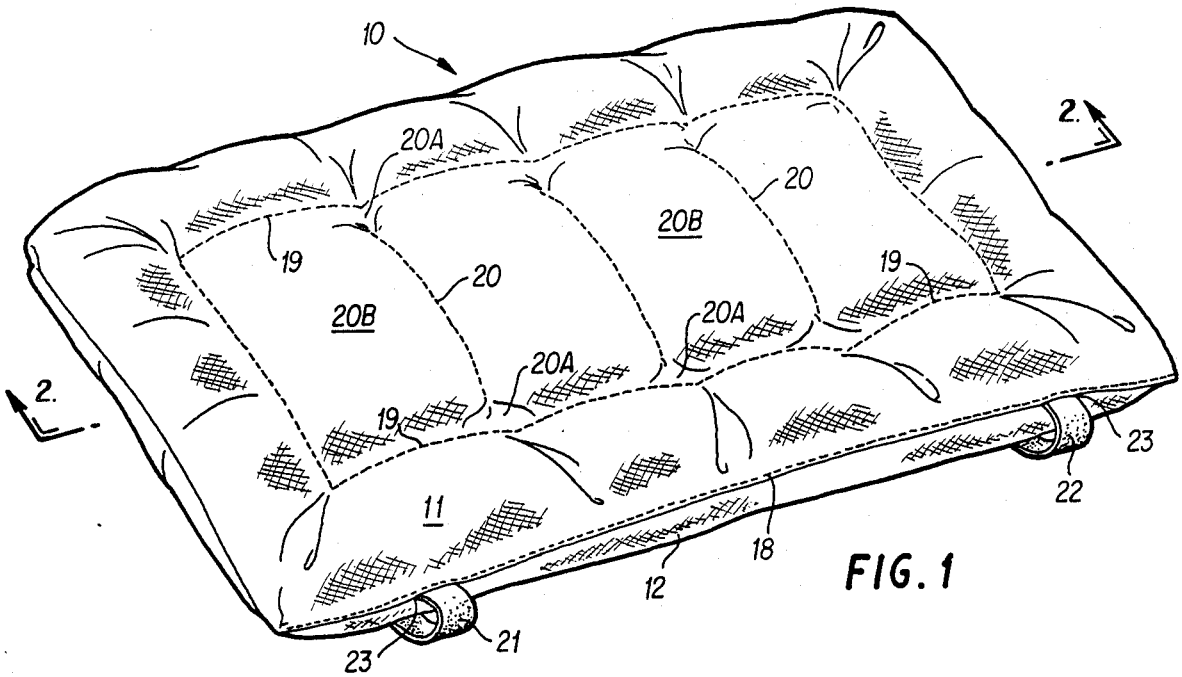
FIG. 1 is a perspective view of a bed pad support for an invalid constructed in accordance with the present invention.
Figure 2:
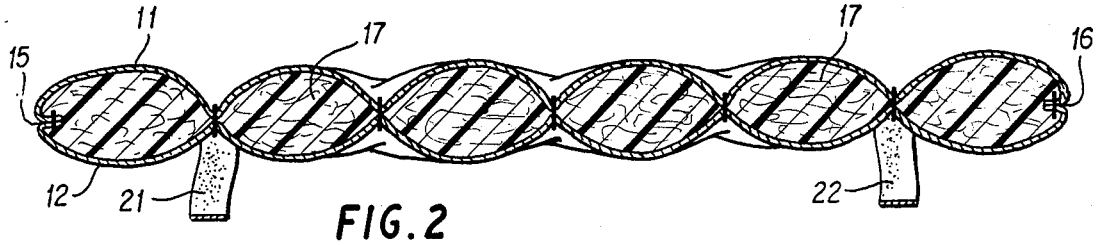
FIG. 2 is a vertical longitudinal sectional view taken on the line 2—2 in FIG. 1.
Figure 3:
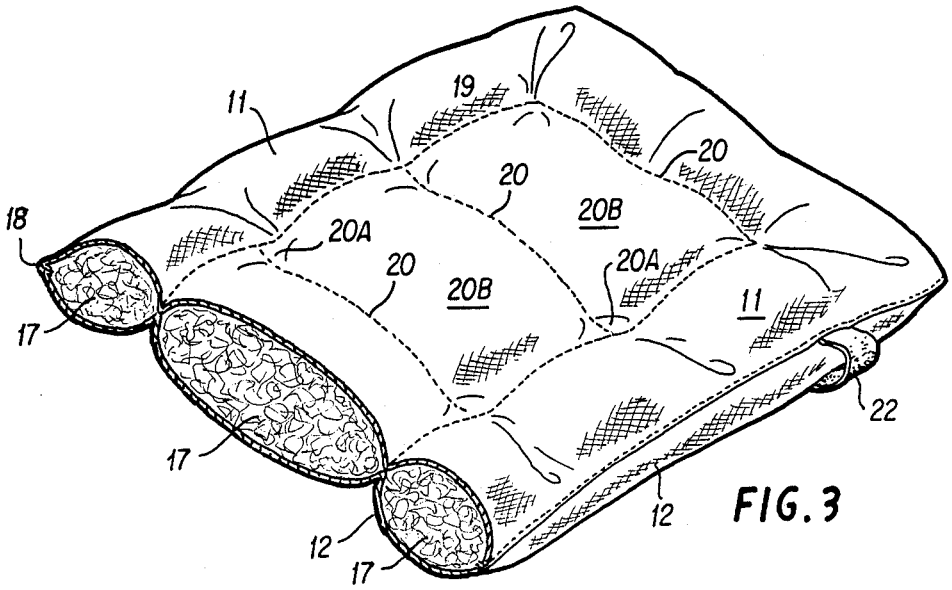
FIG. 3 is a fragmentary perspective view with parts broken away and parts shown in section of the bed pad of FIG. 1.

Referring now to FIGS. 1 and 2, the bed pad 10 of the present invention is constructed of a muslin-cotton and polyethylene fabric comprising 65% polyester and 35% cotton woven in a tight weave having a warp of 76 and a weft of 52 and a weight of 1.83 yards per pound. The external covering fabric has a rectangular top layer 11 and a complemental bottom layer 12 resulting from a folding over of the fabric upon itself. Prior to insertion of the filler which is done along one of the long sides, the cover 11, 12 is constructed in an inverted or inside out condition so that the ends 13, 14 may be stitched along lines 15, 16 after which the filler 17 is inserted. The filler 17 is a loosely formed polyester batting of a slick polyester of 6 denier filaments plus 2 garnetted into the batting filler marketed under the trademark LOFTGUARD® by Celanese Corp. of America and lends a fluff and airy construction to the pad. After insertion of the fluff filler batting 17 the long sides of the top 11 and bottom 12 cover sheets are stitched along line 18. The quilt-like stitching 19 runs longitudinally and stitching 20 runs transversely to lock the filler 17 in place to keep it from sliding. The transverse stitching 20 stops short of the longitudinal stitching 19 leaving an air channel **20*a* which not only permits air to flow between transverse channels 20*b* but also to permit minor shifting of the batting so that the patient does not rest upon a hard non-yielding surface. This provides a pad of a buoyant and airy construction which when placed on a bed beneath a patient and retained in place by resilient straps 21, 22** which are connected to opposite sides of the pad and passed beneath the bed mattress will help to relieve and prevent the pressure which may cause ulcerations and irritation of arthritic joints.

All structural components of the pad such as the cover, front and back as well as filler and stitching are washable to eliminate oder and infection problems which arise due to urination, blood, drainage, etc. The pad may be repeatedly washed, sanitized, dried and reused.

While FIG. 1 shows a small pad such as may be placed beneath a patient's shoulder or buttocks area it will be appreciated that the pad of the present invention may cover the entire top mattress surface area of the patient's bed and is retained in place by the elastic straps 21, 22 the ends of which are stitched or otherwise secured to the pad 10 at 23.

What I claim is:

1. A bed buoyant underbody support for an invalid comprising a rectangular top and bottom sheet of fabric stitched together defining a boundary for said underbody support, comprising 65% polyester and 35% cotton of a 76 inch warp and a 52 inch weft having a weight of 1.83 yards per pound, a buoyant batting filler of a hollow slick polyester batting of 6 denier filaments garnetted into a batting, lines of stitching defining rectangular lines of quilt-like stitching forming an internal set set inwardly from said boundary and having longitudinal and transverse runs joining said top and bottom sheets and defining a channel about the perimeter of said top and bottom sheet, said channel containing air and said bouyant batting filler, transverse quilt-like stitching between the longitudinal runs of said rectangular lines of stitching being set in from the longitudinal runs of said rectangular lines of stitching dividing the internal set of transverse lines of stitching into a plurality of adjacent channels along the major axis of said rectangle and containing air and the buoyant batting filler of hollow slick polyester batting wherein said transverse stitching stops short of the longitudinal stitching of the rectangular lines of quilt-like stitching leaving an opening between the adjacent transverse channels to permit passage of air between channels so that the bed buoyant underbody support is not so rigid as to not provide a resilient buoyant underbody support for an invalid.

* * * * *